United States Patent [19]

Sterling

[11] Patent Number: 4,838,547

[45] Date of Patent: Jun. 13, 1989

[54] INDOOR OUTDOOR EXERCISE CHAIR

[76] Inventor: Joseph F. Sterling, 916 Daytona Ave., Holly Hill, Fla. 32017

[21] Appl. No.: 291,445

[22] Filed: Dec. 27, 1988

[51] Int. Cl.[4] ..... A63B 21/00

[52] U.S. Cl. ..... 272/134; 272/DIG. 4; 272/73; 272/123; 272/136; 272/144

[58] Field of Search ..... 297/118, 217; 272/134, 272/144, DIG. 4, 73, 136, 142, 900, 94, 68

[56] References Cited

U.S. PATENT DOCUMENTS

| | | | |
|---|---|---|---|
| 321,388 | 6/1885 | Ruebsam | 272/134 X |
| 870,776 | 11/1907 | Hamilton | 297/118 |
| 1,973,945 | 9/1934 | Chavin et al. | 272/134 |
| 2,668,709 | 2/1954 | Boyko | 272/134 X |
| 2,855,200 | 10/1958 | Blickman | 272/134 X |
| 3,611,807 | 10/1971 | Brandell | 272/68 |
| 3,738,649 | 6/1973 | Miller | 272/134 |
| 3,968,963 | 7/1976 | Sileo | 272/134 |
| 4,111,415 | 9/1978 | Reitano | 272/94 |
| 4,199,140 | 4/1980 | Ferretti | 272/142 X |
| 4,248,476 | 2/1981 | Phelps | 297/118 |
| 4,358,109 | 11/1982 | Schrems | 272/DIG. 4 X |
| 4,390,177 | 6/1983 | Biran et al. | 272/DIG. 4 X |
| 4,582,319 | 4/1986 | Luna | 272/142 X |
| 4,601,464 | 7/1986 | Mousal | 272/DIG. 4 X |
| 4,634,127 | 1/1987 | Rockwell | 297/118 X |
| 4,700,946 | 10/1987 | Breunig | 272/134 |

FOREIGN PATENT DOCUMENTS

| | | | |
|---|---|---|---|
| 2232118 | 1/1974 | Fed. Rep. of Germany | 272/134 |
| 2065482 | 7/1981 | United Kingdom | 272/144 |

*Primary Examiner*—Richard J. Apley
*Assistant Examiner*—Howard Flaxman
*Attorney, Agent, or Firm*—William M. Hobby, III; Hobby, Wiggins & Beusse

[57] ABSTRACT

An indoor/outdoor exercise chair apparatus includes a back, arms, legs, seat and a space beneath the seat. The chair back has two or more exercising devices embodied therein with a pair of handles extendible from the back of the chair. A head band strap attached to the chair back frame is used for neck exercising and gripping support for abdominal and leg exercises. In each chair arm is located a handle extendible from the chair arm when grasped by a seated person. The chair side frames in the seat have pulling devices similar to those in the chair back and arms and are also used to exercise the arms. Rubber caps are formed in the chair arm ends for hand squeezing and gripping support. An extendible exercise frame with a pedal device can be folded inward and stored against the front chair legs. Two spring clamps are affixed to the two front legs to hold the frame and allow it to be swiveled forward and extended for exercising and backward for storage. The chair back frame also has attached to it an extension support frame so that when the chair is folded backward to a horizontal plane, it is supported by the support frame underneath it. Thus a bench pressing device is formed to accommodate an exercise bar. A portable folding platform base supplies a solid foundation for the chair legs on sand, soft ground, or pebbly surfaces.

18 Claims, 3 Drawing Sheets

INDOOR OUTDOOR EXERCISE CHAIR

BACKGROUND OF THE INVENTION

The present invention relates generally to a chair apparatus and specifically to a chair incorporating an exercising apparatus therein, which can be used indoors and outdoors.

In recent years, the trend to urbanization and mechanization of our society has been a factor in decreasing the amount of exercise in which society members engage. Physician and fitness experts nowadays are concerned with good health and a regular program of physical exercise for all ages. This problem is acute for the urban dweller residing in limited space areas and the elderly also facing these various problems. In an effort to provide home facilities to overcome lack of exercise area and provide an affordable means of obtaining a positive program of exercise activities, various knock-down and collapsible exercising devices have been introduced.

Most prior art devices have not been satisfactory in that collapsible devices must be stored to of sight and devices which store the exercise apparatus are bulky or cumbersome.

The present invention is directed toward a chair which can be used indoors for relaxing and also outdoors in a patio area, backyard or porch, and in which the individual can perform an exercise program while sitting in the chair watching television, listening to music, etc.

Typical prior U.S. patents can be seen in the Levine et al. patent, U.S. Pat. No. 3,056,603, for an exercising machine which is foldable and usable outdoors. It mainly consists of a tubular apparatus in which the main exercising element is a crank which can be used primarily for leg and arm exercises. The Wentz patent, U.S. Pat. No. 2,388,777, shows an exercising apparatus with a pedaling device used in conjunction with a chair. The seated individual positions the apparatus at a desired distance in front of the chair and engages in a pedaling exercise. The Swartz patent, U.S. Pat. No. 3,189,344, is for a body exerciser which is similar to the Levine et al. patent in that it is tubular, foldable and portable. It also includes a crank type exercise element as the Levine et al. patent, enabling the individual to engage in pedaling and arm cranking exercises. The Siloe patent, U.S. Pat. No. 3,968,963, shows a chair type bicycle exercising device which is attached to a chair. Under the chair seat, the apparatus is mounted on a track and can be pulled forward by the seated individual desiring to engage in a pedaling exercise and then pushed back to be stored.

In contrast to these prior art devices, the present indoor/outdoor exercising chair is a conventional beach type lounge chair used indoors, on the patio and the seashore. It has several exercising devices incorporated into the back, arms, sides and a space beneath the chair seat for use by a seated individual without moving from the chair and for providing an exercise routine without leaving the chair, while watching television, listening to music or other entertainment, but which also serves as a portable foldable lounge chair before and after the exercise routine. It also serves as a convenient, affordable portable chair exercise apparatus easily transported to the seashore for exercising while sunning.

SUMMARY OF THE INVENTION

An outdoor/indoor exercise chair apparatus includes a chair, such as a beach type aluminum chair, having a back arms, legs, seat and a space beneath the seats. The chair back has a pair of exercising devices which are embodied in the chair back frame with handles protruding from the chair back and which are ready for use when desired. The handles are extendible from the back when pulled against springs positioned in the frame tubes of the chair back. A similar exercise device is located in each arm of the chair and has a handle extending therefrom. Each handle is extendible from each chair arm against the pressure of a cable connected to a spring mounted in each of the two front legs when pulled by a person seated in the chair. In addition, the chair has a pair of exercising devices extending from the frame sides of the chair with accessible handles protruding from the frame sides. There is also a headband strap mounted in the top frame of the chair for gripping with both hands when lifting or manipulating the legs in abdominal exercises. The headband strap can also be slipped over the head and held firmly against the forehead for neck and upper torso exercises. Rubber caps are formed in the chair arm ends for hand squeezing and gripping support. An extendible tubular frame attached to the bottom of the two front legs by two spring clamps is folded inward in a stored position and is held firmly against the chair legs and support member by Velcro adhesive pads mounted on the frame and support member between the two front legs. A pedal device is also embodied into the frame, along with a telescoping tube and handle so when the extendible frame is pulled forward from its stored position, swiveling in the spring clamps mounted on the two front legs and is adjusted by telescoping to the proper distance desired in front of the chair. The person sitting in the chair can then use the pedal device with the adjusted telescopic tube and handle giving him support in the chair with the pedaling exercise.

The chair back frame also has an extension support frame affixed to it with a spring clamp and a swivel lever. The extension support frame can be detached from the spring clamp by a pulling motion so when the chair back frame is released from the chair arms by pulling out the holding spring release pins embodied in the chair arms and chair back so that it falls backward to rest on the extension support frame placed under the chair back, resulting in a horizontal bench position. Two bar holders telescoping out of a parallel tubing member attached to the outside of the extension support frame can then be adjusted to a height over the horizontal chair back frame. At the adjusted height, the bar holders can support a small exercise bar on which several plastic discs can be placed for bench pressing. These discs with screw caps can be filled with sand or water to give a determined weight resistance for exercising at home or the seashore. Other exercises such as curling, overhead pressuring can also be performed by the exercising person.

All the various exercise devices mentioned herein and attached or integrated into the construction of the indoor/outdoor exercise chair does not interfere with a folding of the chair, making it an exercise device which can be transported from the patio area to the seashore for exercising at either place. For beach use, a specially designed portable flat platform can be made of either wood or plastic or other substance and will serve as a base over the sand for the legs and exercise frames of the exercise chair.

BRIEF DESCRIPTION OF THE DRAWINGS

Other objects, features and advantages of the present invention will be apparent from the written description and the drawings in which.

DESCRIPTION OF THE PREFERRED EMBODIMENTS

Figure 1:
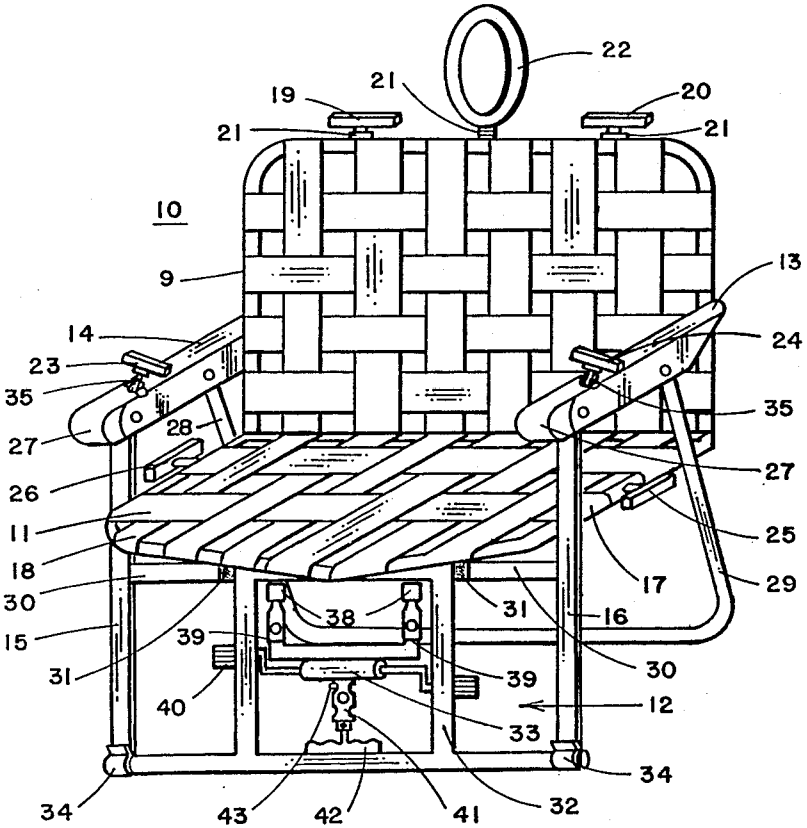
FIG. 1 is a perspective view of an indoor-outdoor exercise chair in accordance with the present invention.

Referring to the drawings and especially to FIG. 1, a beach type lounge chair 9 is used to illustrate the indoor/outdoor exercise chair, and is shown as having a back 10, a seat 11, space 12 under the seat, arms 13 and 14, legs 15, 16, 28, 29 and two sides 17 and 18. A pair of handles 19 and 20 are shown resting on plastic washer seats 21 and embodied in the top of the chair 9 back 10. The top of the chair 9 back 10 also has a headband type strap 22 attached and resting on a plastic washer seat 21. The chair arm 13 has a grip handle 24, while chair arm 14 has a handle 23, each attached to an elastic cable 35 extending through the arms 13 and 14. A pair of rubber caps are formed on the end of each arm 13 and 14 for squeezing or grasping or supporting the body while lifting the legs or the back. The chair 9 also has two sides 17 and 18 in the seat 11 frame having handles 25 and 26 attached to the sides 17 and 18. Also seen in the bottom view of the exercise platform frame 32 on which is mounted the pedal device frame 33, the twin yoke tubing 39, the ratchet adjusters 38, the support tube 41 and handle 42. The exercise platform 32 is folded against chair cross member 30 under the seat 11 and is held firmly against the cross member 30 with Velcro adhesive pads 31, mounted on the top member of frame 32 and on the cross member 30. These two pad areas line up for adhesion when the frame 32 is raised upward to its storage position under seat 11. The exercise platform frame 32 also has the bottom cross member clamped in two spring type clamps 34 attached to each of the chair legs 15 and 16. The spring clamps 34 each allow the frame 32 to be swiveled upward or downward as desired. The frame 32 can be detached entirely from the chair legs 15 and 16 if so desired.

Figure 2:
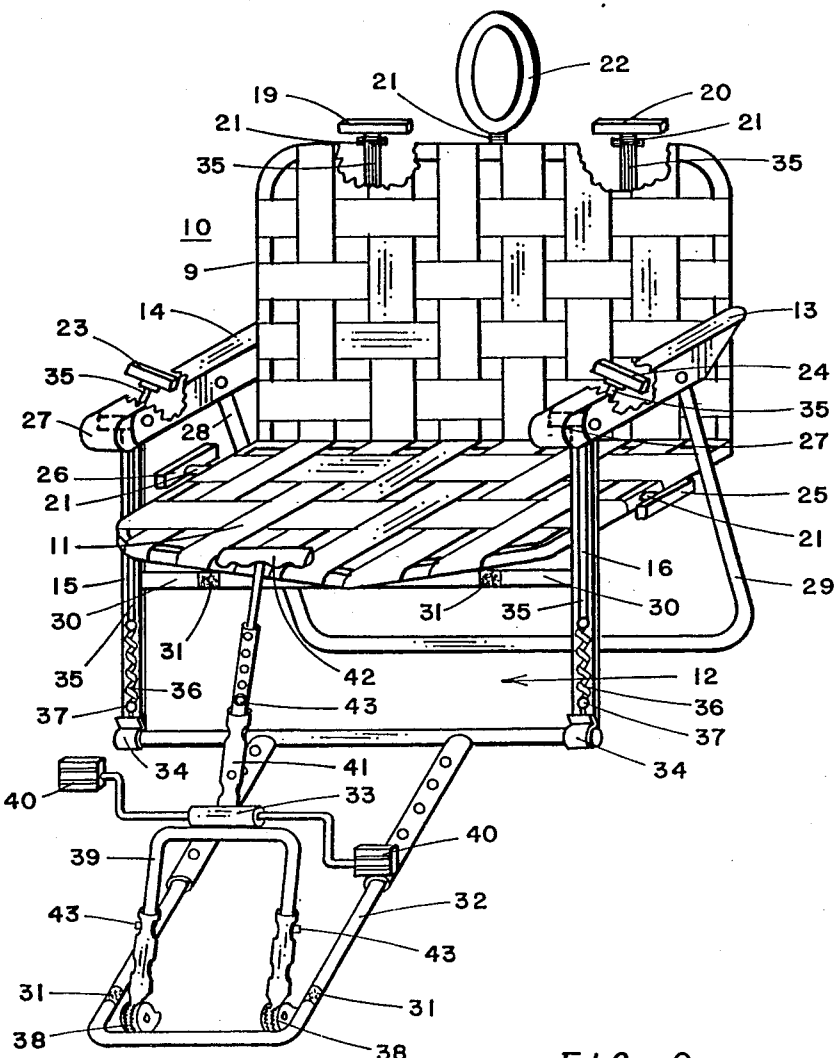
FIG. 2 is a cutaway perspective view of the chair of FIG. 1 showing the exercising devices therein and having the exercising platform extended.

As more clearly seen in FIG. 2, the handles 19 and 20 each has a cord or cable 35 attached to it after threading through a tubing member of chair back 10 frame. The cord 35 is attached to a spring 36 which in turn is fastened to an eye hook 37 fastened to the end of legs 15 and 16. In the chair arms 13 and 14, the handles 23 and 24 are attached to the cords 35 which extend through legs 15 and 16 and are then attached to springs 36 fastened to the bottoms of legs 15 and 16. Handles 25 and 26 located in the chair sides 17 and 18 are positioned horizontally and seated on washer bases 21 ready to be grasped by a seated person and pulled outward for exercising. Also seen in FIG. 2 is the headband strap 22 which is seated on washer base 21. The headband strap 22, may be hanging loosely on the front of chair 9 or the chair back 10. This headband strap can be made of a leather, nylon, or plastic material coated with a sweatband. Its primary function is for neck exercise but can also give gripping support for abdominal leg raises. The exercise platform frame 32 is shown extended outward from its storage place under the seat 11 to a selected distance in front of chair 9 with the pedal device yoke 39 telescoped to the proper height and adjusted by the ratchet adjusters for the right exercising angle. The support tube 41 and handle 42 are telescoped out of their tubular members to the proper heights selected by the seated person. When these selected adjustments to the pedaling device are completed, the seated individual can then conduct a vigorous pedaling exercise. The grip handles 19, 20, 23, 24, 25 and 26 are each connected to a cable 35, which in turn is connected to a spring 36 hooked to a fastener 37 so that when handles 19, 20, 23, 24, 25 and 26 are pulled, each cable 35 pulls against a spring 36 held by a fastener 37 to act as an exercising device. The headband strap 22 which is riveted through a plastic washer base 21 to the top of the chair back 10 is fashioned from an elastic type material. It is slipped over the head against the forehead so that moving the head in a forward and backward motion will provide exercise for the neck and upper torso. At the end of each chair arm 13 and 14 is formed a resilient rubber hand grip cap 27 for a seated individual to exercise his hands by compressing and releasing the hand grip caps 27.

Figure 3:
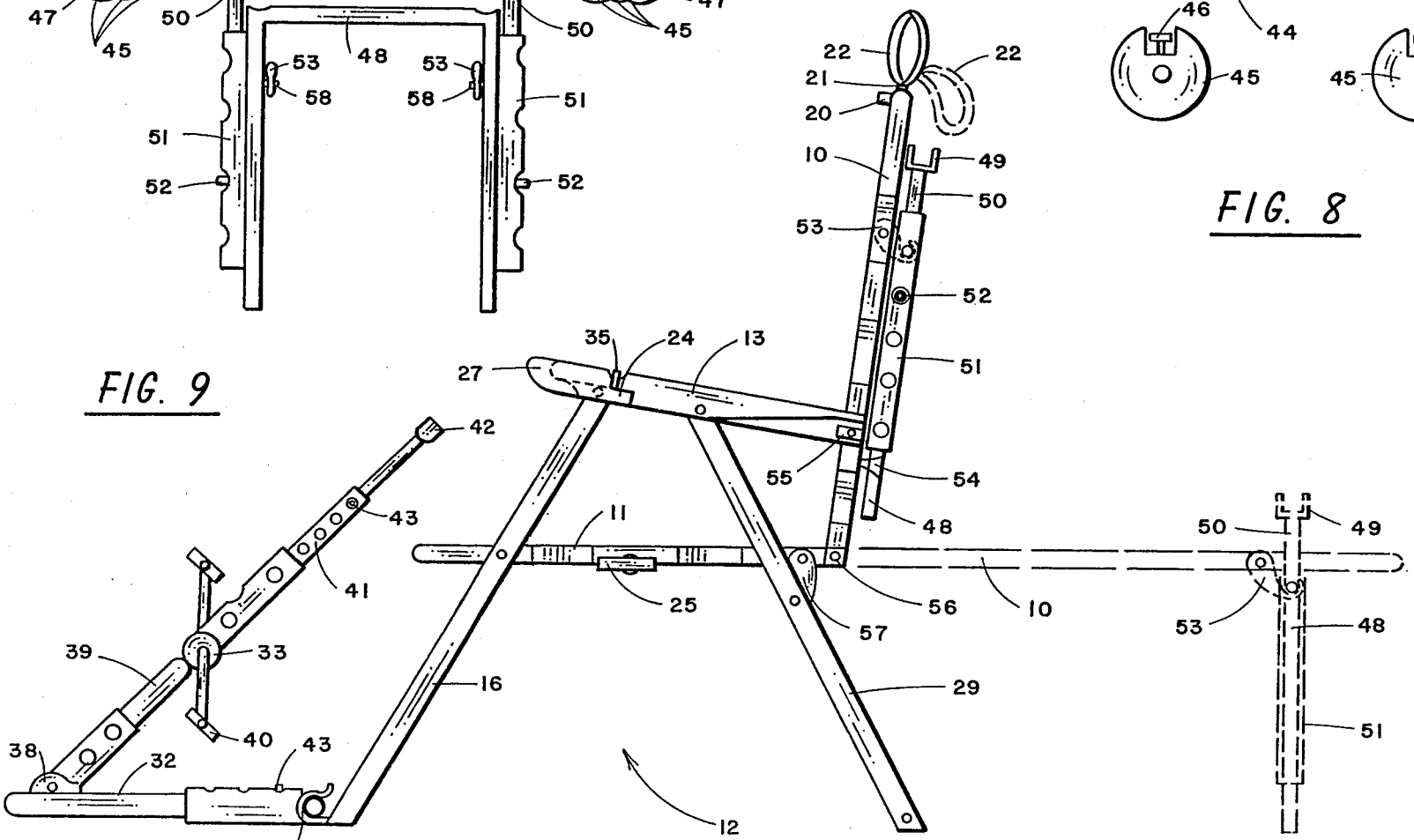
FIG. 3 is a side sectional view of the chair in FIG. 1 showing the exercising platform with the pedal mount support rod and handle attached and extended.

Referring to FIG. 3, an exercise chair 9 has the exercise platform 32 swiveled forward in clamp 34 and telescoped or adjusted to a distance in front of the chair 9, along with twin yoke 39 elevated to a selected height and angle by ratchet 38, the support tube 41 and handle 42 are also telescoped to a selected height compatible to a seated person in chair 9 who can then begin a desired exercise routine. These various telescopic adjustments of the aforementioned embodiments are accomplished with the use of a spring clip button 43 incorporated in the tubular members of the embodiments. To explain more clearly a spring clip with button 43 is riveted to the inner tubular member to be telescoped out of the outer tubing which has various drilled holes spaced apart in the outer tubing. When pressure is applied by the thumb or finger against the spring clip button 43, it is depressed out of its present hole or opening and is held compressed by the tubular member moving over it until another hole or opening is reached where the pressure of the spring clip forces the button 43 into the new opening where it is then seated and locked until moved to the next opening. The grip handles 20, 24, 25 are shown resting in their respective locations or positions on chair 9. Handle 24 is also shown affixed to cable 35 in chair 9 arm 13. The headband strap 22 is positioned over the top of chair 9 so it can be clearly defined and is also shown in a hanging position behind chair back 10. The chair arm 13 has the rubber grip cap 27 formed on the end of arm 13. In FIG. 3, the chair back 10 has the extension support frame 48 attached to the notched extrusion 58 by the lever spring clamp 53 and the lower spring clamp 54 as shown. The extension support frame 48 has the tubular member 51 attached thereto. The tubing member 51 houses the exercise bar holder 49 and the holder tube 50. After releasing the support frame 48 from the lower spring clamp 54, the frame 48 is still attached to the back 10 by the lever spring clamp 53. The chair back 10 is then released from the chair arm 13 by pulling out the quick release pin 55 which has been seated in a drilled hole in the back 10. The back 10 can then be lowered by swiveling it with the lever swivel pin 56 to rest on the extension support frame 48 which is set under back 10 resulting in a horizontal bench position. The level spring clamp 53 allows the extension support frame 48 to be swiveled and be also held firmly by the lever clamp 53 which is mounted on the inner side of frame 48 in accordance with FIG. 9.

Figure 4:
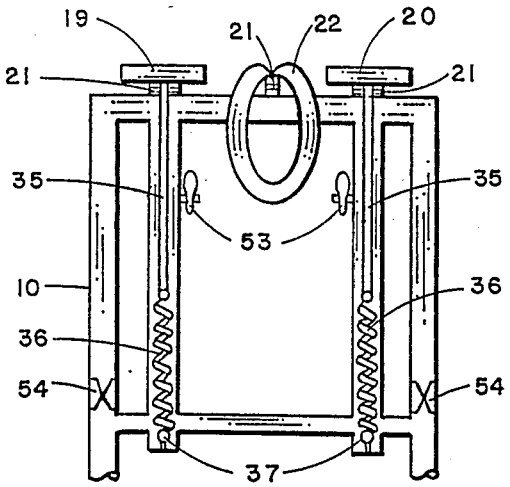
FIG. 4 is a perspective cutaway view of the chair back frame showing the integrated handle pulling devices within the vertical members.
Figure 5:
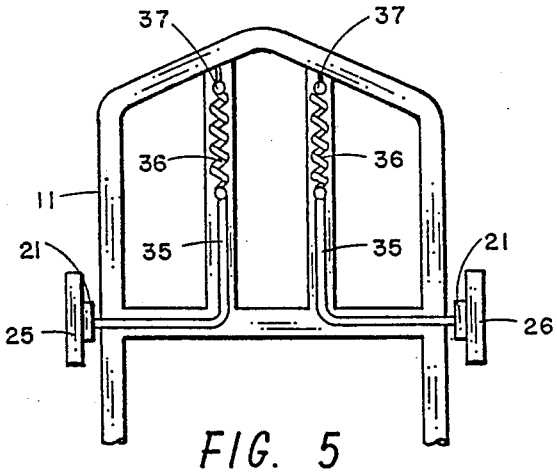
FIG. 5 is a perspective cutaway view of the chair seat frame showing the integrated handle pulling devices within the horizontal members.

Referring to FIGS. 4 and 5, the chair 9 back 10 frame is shown in FIG. 4, void of its webbing material to show clearly the extra vertical tubular members reinforced with a horizontal cross member that has been added. From the grip handles 19 and 20 at the top of the chair back 10 and the plastic washer base 21 are seen threading through the two vertical tubular members, the connected cables 35 which are connected to the springs 36, which are also fastened to the fasteners 37. When the grip handles 19 and 20 connected to the cables are pulled outward and forward against the springs 36, resistance is provided by the cables and springs to act as exercising device. The lever spring clamp 53 and the spring clamp 54 are both attached and visible on the chair back 10. In FIG. 5, the chair seat 11 is shown void of webbing to define more clearly the two extra horizontal tubular members reinforced with a third perpendicular member. The grip handles 25 and 26 are attached to the cables 35, connected to springs 36 and fastened to fasteners 37. Gripping the handles 25 and 26, connected to the cables 35 and pulling them outward and to the side will also pull against the springs 36 providing the resistance to act as an exercising device.

Figure 6:
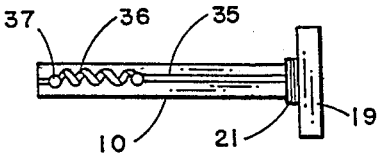
FIGS. 6 is a sectional view of one of the chair back handle exercising devices in accordance with FIGS. 1 and 2.

Turning to FIG. 6, one of the grip exercising handles 19 is shown connected to a cable 35 connected to a spring 36 which is connected to a fastener eyelet 37. The spring 36 rides in the vertical tubular member of the chair back 10 along with cable 35 in accordance with FIG. 4. The spring is fastened to the eyelet 37 which is formed in the end of the tubular member. Each of the other exercise handles 20, 23, 24, 25 and 26 each operate in the same manner as illustrated in FIGS. 2 and 4.

Figure 7:
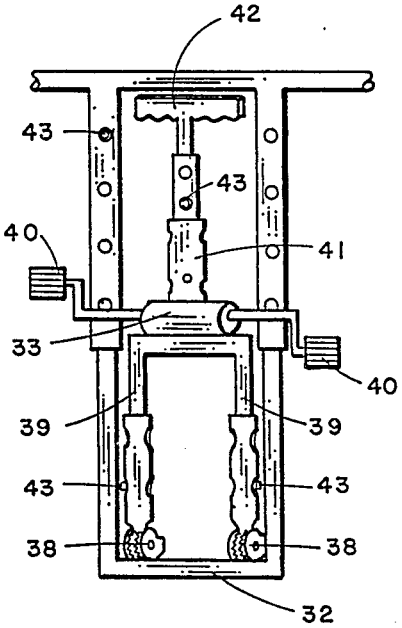
FIG. 7 is a sectional view of the exercising platform frame with the pedal device, support tube and handle mounted on it in accordance with FIGS. 1, 2 and 3.

FIG. 7 is a detailed view of the detachable exercise platform frame 32. The frame 32 consists of two telescopic tubular members attached to a perpendicular cross member which can be clamped in the spring clamps 34 fastened to the bottoms of chair 9 legs 15 and 16. The clamps 34 allow the frame 32 to be lifted or lowered in the clamps 34. Mounted to the frame 32 are ratchet devices 38 to which is connected the twin yoke section 39 with two tubular members. On the yoke 39 is mounted the pedal mount 33 with pedals 40 attached, and mounted on the pedal device 33 is the telescopic support tube 41 and handle 42. All the telescopic tubular sections aforementioned are adjusted or telescoped by means of spaced drilled apertures in the outer tubular members. The spring clip button 43 is affixed to the inner tubing and reaches or slides into and seats itself in a locking aperture or spaced hole position selected by the seated person. The spring clip button 43 is riveted to the inner tubing and when pressed out of a spaced hole with a thumb or finger, it is kept further depressed by the outer tubing sliding over button 43 until a spaced hole appears whereby the button 43 pops up with the pressure of the spring clip 43, therein seating and locking itself in the desired spaced hole. The ratchet devices 38 raise and adjust the twin yoke 39 to the proper angle whereupon the yoke 39 is telescoped and adjusted to the proper height for the pedal device 33. The next adjustment is made to the support tube 41 and handle 42 raising it to the proper height necessary for handle 42 gripping and support by the seated person beginning the exercise routine.

Figure 8:
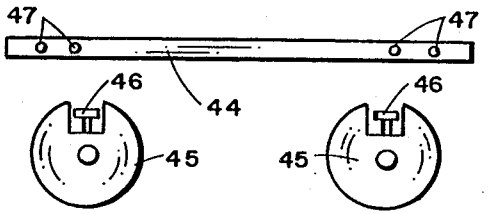
FIG. 8 is a sectional view of the exercise bar and two plastic hollow discs in accordance with FIGS. 3 and 9.

In FIG. 8 the illustration shows a plastic exercise bar 44 with spaced holding bolts 47 between which can be mounted the hollow plastic discs 45 equipped with removable screw caps 46. The removable screw caps 46 embodied in the plastic hollow discs 45 enable one to fill the discs 45 with water or sand for use at the seashore. The exercise bar 44 and discs 45 can be used in accordance with the embodiments illustrated in FIGS. 3 and 9.

Figure 9:
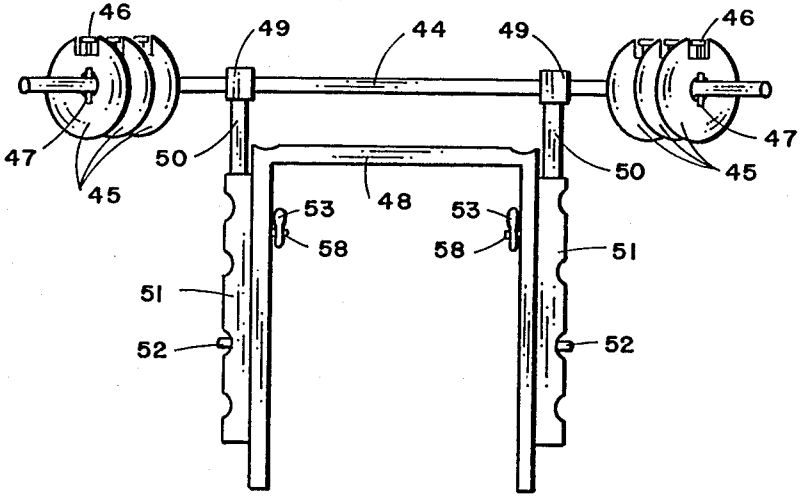
FIG. 9 is a sectional view of the extension support frame and attached bar holder tubing members showing the two bar holders telescoped out of the member tubing with the exercise bar resting in the bar holders and the plastic hollow discs mounted on the bar in accordance with FIGS. 8 and 3.

In FIG. 9 a detailed view of the assembly of the exercise bar 44 is illustrated with related components forming the bench pressing device in accordance with FIGS. 3, 8 and 9. The exercise bar 44 is shown resting on the bar holders 49 elevated by the holder tube 50 housed and riding in the tubing member 51 which is affixed to extension support frame 48. The support frame 48 is affixed to the chair back 10 by the lever spring clamp 53 and spring clamp 54 both mounted on the chair back 10. Both these clamps 53 and 54 allow the frame 48 and affixed tubular member 51 to be put in a storage position on chair 9 back 10 and be detachable from chair 9 back 10 for assembly to the horizontal bench pressing position and also be removable as desired. The bar holder tube 50 is adjusted to the desired exercising height by the spring clip button 52 which functions in the same manner as the spring clip 43 used in accordance with FIGS. 2, 3 and 7.

Figure 10:
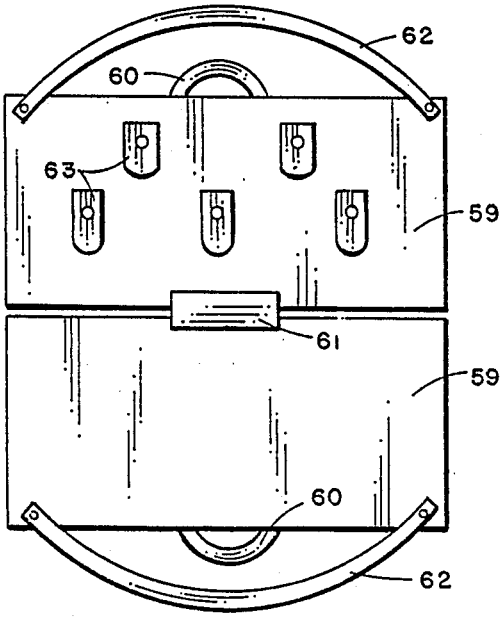
FIGS. 10 is a perspective view of the portable, flat platform serving as a flat base for the chair of FIGS. 1, 2 and 3.
Figure 11:
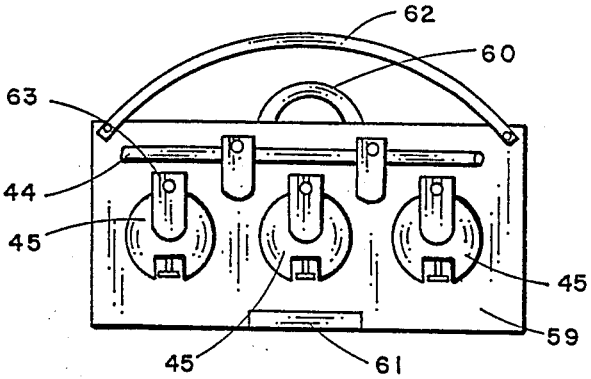
FIG. 11 is a perspective view of the portable flat platform folded in a carrying position with the exercise bar and discs attached.

FIGS. 10 and 11 show a portable exercise platform 59 which can be transported and used, for example at the seashore. In FIG. 10, the platform base 59 has carrying handles 60 and folding hinge 61. The platform 59 can be constructed of plywood, plastic, aluminum, or other compatible substance which can be used on sand at the seashore.

FIG. 11 shows the portable platform 59 in a folded carrying position with the exercise bar 44, plastic discs 45 fastened to the platform 59 for carrying means with Velcro pad straps 63 riveted it the platform 59. Also shown with the carrying handle 60 is a nylon fabric shoulder carrying strap 62 which can be used optionally as a carrying means.

I claim:

1. An indoor/outdoor exercising chair apparatus comprising in combination:

a chair having a substantially vertical back, a pair of arms releasably attached to the chair back for supporting said chair back, two sides a seat, said seat having a space therebeneath, and legs for supporting said chair;

a pair of back resilient exercising members mounted in said chair back and each having a handle extending from said back, and each said handle being extendible away from said back when grasped and pulled by a person seated in said chair;

an arm resilient exercising member mounted in each arm of said chair and having a handle attached thereto and extending from the arm of said chair, each said handle being extendible away from said chair arm when pulled by a person seated in said chair;

a seat resilient exercising member mounted in each side of said chair seat and each having a handle attached thereto and extending therefrom, each handle being extendible outward from the side of said chair seat when pulled by a person seated in said chair;

a flexible resilient strap attached to said chair back and extending upwardly therefrom so that a seated person in the chair may grasp the strap to exercise their abdomen and legs;

a resilient hand grip formed on one end of said each chair arm so that a seated individual can exercise his hands by compressing the resilient hand grips;

an extendible and detachable exercise platform frame attached to said chair legs, said frame being extendible from a storage position under said chair seat to an extended position partially extending in front of said chair;

a pedal mechanism having a pair of pedals and attached to said platform frame, said pedal mechanism having adjustment means for adjusting for an individual user so that the pedal mechanism can be used by a seated individual;

extension support frame means attached to the chair back for converting said chair apparatus to a bench press platform when the chair back is detached from the chair arms, rotated to a substantially horizontal position and supported by said extension support frame means, said extension support frame means including means for supporting an exercise bar above said platform; and a platform base for supporting said chair apparatus in sand or the like, whereby a portable indoor and outdoor exercise chair allows exercising while seated in the chair.

2. An exercising chair apparatus in accordance with claim 1 in which said pair of back resilient exercising members each includes a cable and spring, said cable and spring being located in a vertical tubular member of the chair back and each spring being fastened to an eyelet fastener formed in the bottom of each of the vertical tubular members so that said cable and spring are extendible when pulled by a seated person.

3. An exercising apparatus in accordance with claim 1 in which each said arm resilient exercising member is attached to a cable and spring located in a leg vertical tube and each spring is fastened to an eyelet fastener in the bottom of the leg vertical tube.

4. An exercising apparatus in accordance with claim 1 in which each seat resilient exercising member includes a cable and spring, said cable and spring being located in a seat horizontal tubular member and each said spring being fastened to an eyelet fastener formed in the horizontal tubular member of the seat of said chair apparatus so that said cable and spring are extendible when pulled by a seated person.

5. An exercising chair apparatus in accordance with claim 1 in which said flexible resilient strap forms a headband and is fastened to the chair back whereby a seated person in said chair can slip the headband strap over the head to exercise the neck and upper torso muscles.

6. An exercising chair apparatus in accordance with claim 1 in which each said resilient hand grip is formed of a resilient rubber on each chair arm end.

7. An exercising chair apparatus in accordance with claim 1 in which said chair includes two front legs and said extendible and detachable exercise platform frame is attached to the chair apparatus two front legs with two spring clamps, each fastened adjacent to the bottom of each of the two front legs, said two spring clips movably mounting said extendible and detachable exercise platform frame and said pedal mechanism attached thereto from an unfolded position to a folded storage position under said chair seat and said said chair apparatus having at least one VELCRO pad positioned for holding said extendible and detachable exercise platform frame and said pedal mechanism in a folded storage position.

8. An exercising chair apparatus in accordance with claim 1 in which said support frame is attached to chair and can be detached and the chair back detached from the chair arms and lowered into a horizontal position, and the extension support frame placed under the chair back to convert the chair apparatus to a bench pressing platform.

9. An exercising chair apparatus in accordance with claim 8 having an exercise bar holder tube housed in a tubular member attached to the support frame, said bar holder tube being adjustable to a selected height.

10. An exercising chair apparatus in accordance with claim 9 including an exercise bar and a plurality of hollow containers removably attachable to said exercise bar and each hollow container a removable cap whereby each hollow container can be filled with a fluid to supply weight when placed on the exercise bar.

11. An exercising chair apparatus in accordance with claim 1 including an adjusting and locking means for the exercising platform frame, said adjusting and locking means having a spring clip button riveted into an inner telescoping tube located in an exercise frame tube, and said spring clip button being movable into and out of one of a plurality of spaced openings in the exercise frame tube to thereby lock and unlock said telescoping tube in place.

12. An exercising chair apparatus in accordance with claim 1 in which said extension support means frame includes a telescoping twin yoke frame having a pair of inner telescoping tubes telescoping into and out of said twin yoke frame outer tubes, said telescoping tubes having a spring clip button riveted into an inner telescoping tube located in an twin yoke frame tubes, and said spring clip button being movable into and out of one of a plurality of spaced openings in the the twin yoke frame tube to thereby lock and unlock said telescoping tubes in place.

13. An exercising chair apparatus in accordance with claim 1 in which said pedal mechanism adjustment means includes a locking means for a support tube and handle and said support tube having an inner telescoping tube telescoping into and out of an outer support tube and said locking means includes a spring clip button movable into and out of one of a plurality of spaced openings in the outer telescoping tube to thereby lock and unlock said telescoping tubes in place.

14. An exercising chair apparatus in accordance with claim 12 in which the extension support frame adjusting and locking means and the bar holder includes two lever spring clamps attached to the chair vertical legs, said two lever spring clamps being snappable onto two notched extruding knobs mounted onto the the extension support frame.

15. An exercising chair apparatus in accordance with claim 1, in which the extension support frame means in detachable from said chair back frame by a pair of lever spring clamps attached to the said chair back.

16. An exercising chair apparatus in accordance with claim 1 in which said platform base is made of wood.

17. An exercising chair apparatus in accordance with claim 1 in which said platform base has an adjustable carrying shoulder strap and carrying handle grips.

18. An exercising chair apparatus in accordance with claims 17 in which said platform base has VELCRO straps affixed to both sides of the said platform base, said VELCRO straps removably strapping an exercise bar and hollow containers on the platform base for transportation therewith.

* * * * *